US011522303B1

(12) United States Patent
Shimmel et al.

(10) Patent No.: US 11,522,303 B1
(45) Date of Patent: Dec. 6, 2022

(54) TERMINAL POST ASSEMBLY FOR TERMINATION OF ELECTRICAL TERMINALS WITHOUT THE NEED FOR TOOLING

(71) Applicant: TE Connectivity Services GmbH, Schaffhausen (CH)

(72) Inventors: Destin Shimmel, York, PA (US); Nicholas Paul Ruffini, Lancaster, PA (US); Keith Edwin Miller, Manheim, PA (US); Charles Raymond Gingrich, III, Mechanicsburg, PA (US); Kyle Gary Annis, Hummelstown, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/346,346

(22) Filed: Jun. 14, 2021

(51) Int. Cl.
*H01R 4/30* (2006.01)
*H01R 4/36* (2006.01)
*H01R 4/22* (2006.01)

(52) U.S. Cl.
CPC ..... *H01R 4/305* (2013.01); *H01R 4/22* (2013.01); *H01R 4/363* (2013.01)

(58) Field of Classification Search
CPC ..... H01R 4/4872
See application file for complete search history.

(56) References Cited

U.S. PATENT DOCUMENTS 4,643,513 A * 2/1987 Martin ..... H01R 4/34 439/788
4,997,396 A * 3/1991 Gold ..... H05B 3/84 219/547
5,964,625 A * 10/1999 Farley ..... H01R 4/4872 439/817
8,303,357 B2 * 11/2012 Kuwahara ..... H01R 4/26 439/444

* cited by examiner

*Primary Examiner* — Ross N Gushi

(57) ABSTRACT

A terminal post assembly for connecting at least one electrical terminal to a substrate. The terminal post assembly includes a terminal post which has a substrate mounting portion, a terminal receiving portion and a cap receiving portion. The substrate mounting portion has a base and a securing portion which is dimensioned to extend through a mounting opening of the substrate. The terminal receiving portion is configured to receive the at least one electrical terminal thereon and make an electrical connection to the at least one electrical terminal. The cap receiving portion has a cap positioned thereon. the cap cooperates with the at least one electrical terminal to retain the at least one electrical terminal in position on the terminal receiving portion to maintain the electrical connection between the at least one electrical terminal and the terminal receiving portion of the terminal post of the terminal post assembly.

8 Claims, 9 Drawing Sheets

TERMINAL POST ASSEMBLY FOR TERMINATION OF ELECTRICAL TERMINALS WITHOUT THE NEED FOR TOOLING

FIELD OF THE INVENTION

The invention is directed to a terminal post assembly for termination of electrical terminals without the need for tooling. In particular, the invention is directed to a terminal post assembly which has a cap which retains the terminals in electrical engagement with the terminal post.

BACKGROUND OF THE INVENTION

Terminal posts are often positioned on substrates, such as panels, bulkheads or brackets to enable the electrical termination of terminals to the substrate, etc. However, the proper termination of the terminals to the terminal posts often requires the use of one or more tools. The use of tools may be difficult in various application in which the terminal posts are located in confined or hard to access spaces.

It would, therefore, be beneficial to provide a terminal post assembly which overcomes the issues associated with known terminal posts. In particular, it would be beneficial to provide a terminal post assembly which allows for the termination of electrical terminals to the terminal post without the need for additional tooling.

SUMMARY OF THE INVENTION

The following provides a summary of certain illustrative embodiments of the present invention. This summary is not an extensive overview and is not intended to identify key or critical aspects or elements of the present invention or to delineate its scope.

An embodiment is directed to a terminal post assembly for connecting at least one electrical terminal to a substrate. The terminal post assembly includes a terminal post which has a substrate mounting portion, a terminal receiving portion and a cap receiving portion. The substrate mounting portion has a base and a securing portion which is dimensioned to extend through a mounting opening of the substrate. A securing member is attached to the substrate mounting portion to retain the substrate mounting portion and the terminal post assembly in electrical connection with the substrate. The terminal receiving portion is configured to receive the at least one electrical terminal thereon and make an electrical connection to the at least one electrical terminal. The cap receiving portion has a cap positioned thereon. the cap cooperates with the at least one electrical terminal to retain the at least one electrical terminal in position on the terminal receiving portion to maintain the electrical connection between the at least one electrical terminal and the terminal receiving portion of the terminal post of the terminal post assembly.

In one embodiment, the cap has a cap securing portion and a resiliently deformable portion which extends from the securing portion, the securing portion cooperates with the terminal post to retain the cap on the terminal post.

In one embodiment, the terminal receiving portion of the terminal post is movable between a first position, in which the at least one electrical terminal can be positioned in the terminal receiving portion, and a second position, in which the at least one electrical terminal is secured in the terminal receiving portion.

In one embodiment, the cap receiving portion is at least one cap securing shoulder which extends outwardly proximate an end of the terminal receiving portion, the at least one cap securing shoulder cooperates with at least one recess in the cap to retain the cap in position on the terminal post.

Additional features and aspects of the present invention will become apparent to those of ordinary skill in the art upon reading and understanding the following detailed description of the illustrative embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more illustrative embodiments of the invention and, together with the general description given above and detailed description given below; serve to explain the principles of the invention, and wherein.

DETAILED DESCRIPTION OF THE INVENTION

Figure 1:
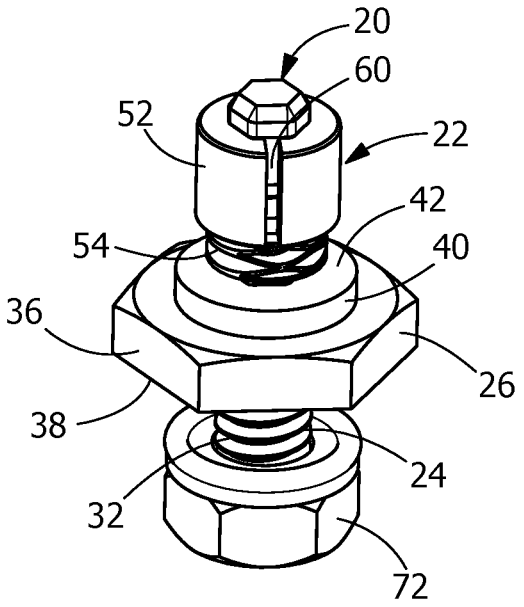
FIG. 1 is a perspective view of an illustrative terminal post assembly of the present invention.
Figure 2:
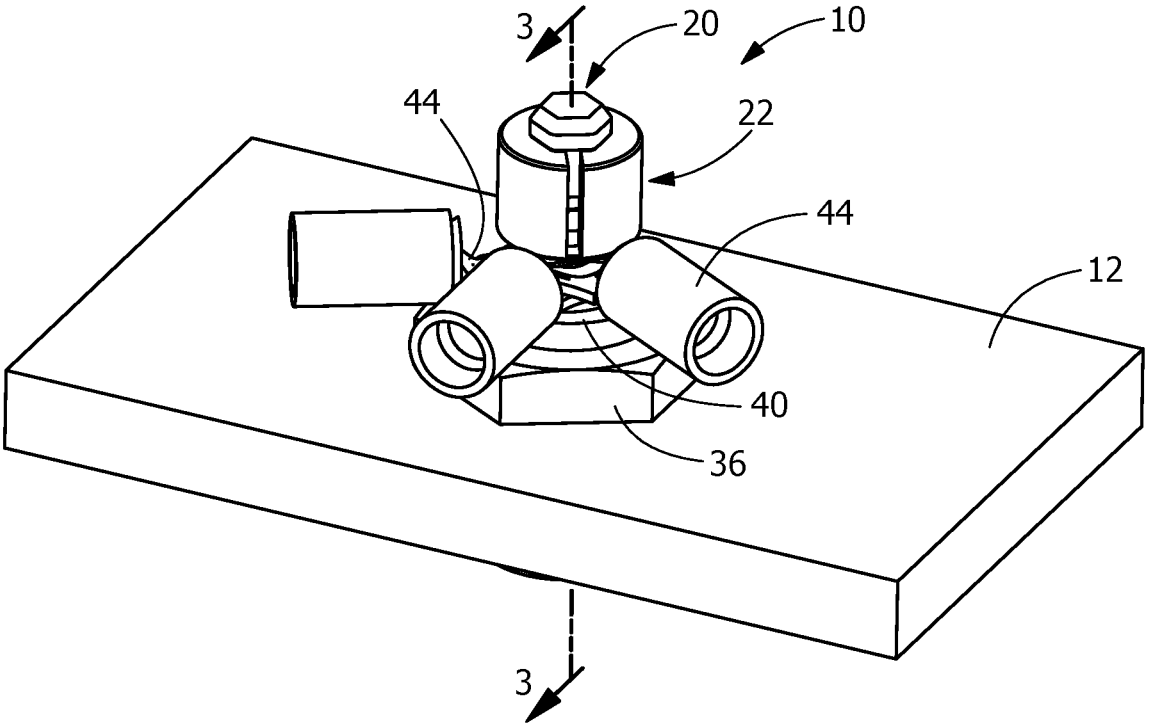
FIG. 2 is a perspective view of the terminal post assembly of FIG. 1, mounted on an illustrative substrate.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Illustrative embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

A first illustrative embodiment is shown in FIGS. 1 through 7. A terminal post assembly 10 is configured to mounted on a substrate 12, such as, but not limited to, a panel or other component.

The terminal post assembly 10 includes a terminal post 20 and a spring cap 22. The terminal post 20 has a substrate mounting section 24, a base section 26, a terminal receiving section 28 and a cap receiving section 30.

In the illustrative embodiment shown, the substrate mounting section 24 extends from the base 26. The substrate mounting section 24 has threads 32. The diameter of the substrate mounting section 24 is smaller than the diameter of a mounting opening 34 which extends through the substrate 12.

The base section 26 has a first portion 36 which has a diameter which is larger than the mounting opening 34. The first portion 36 has a substrate engaging surface 38 which is configured to make an electrical engagement with a surface of the substrate 12. The base section 26 has a second portion 40 which has a diameter which is smaller than the diameter of the first portion 36. The second portion 40 has a terminal support surface 42 which is configured to engage terminals 44 positioned in the terminal receiving section 28. The particular configuration and relative size of the first portion 36 and the second portion 40 may vary without departing from the scope of the invention.

The terminal receiving section 28 extends from the terminal support surface 42 of the second portion 40 of the base section 26 in a direction away from the substrate mounting section 24. In the illustrative embodiment shown, the terminal receiving section 28 is configured to receive between one and three terminals 44, however, in other embodiments, the terminal receiving section 28 may be configured to receiving other number of terminals 44. As viewed from the cap receiving section 30, the terminal receiving section 28 has a hexagonal shape.

The cap receiving section 30 extends from the terminal receiving section 28 in a direction away from the base section 26. The cap receiving section 30 has a first recess or cavity 46 and a second recess or cavity 48 which is spaced from the first recess 46. In the illustrative embodiment shown, the first recess 46 and the second recess 48 extend about the entire circumferences of the cap receiving section 30, however, other configurations of the first recess 46 and the second recess 48 may be used. The first recess 46 is provided proximate a free end of the cap receiving section 30. The second recess 48 is provided proximate the terminal receiving section 28. A sloped or lead in surface 50 is provided at the free end of the cap receiving section 30. In the illustrative embodiment, the cap receiving section 30 has a hexagonal shape.

The cap 22 has a securing section 52 and a resilient or spring section 54. The securing section 52 has an opening 56 which extends longitudinally through the length of the securing section 52. The opening 56 has a hexagonal configuration which similar to the configuration of the cap section 50. One or more securing projections 58 extend inward into the opening 56. In the embodiment shown, one securing projection 58 is shown which extends circumferentially about the opening 56. A slot 60 extends longitudinally along the length of the securing section 52. The slot 60 extends to the opening 56, thereby allowing portions of the securing section 52 to move independently of each other.

The resilient or spring section 54 extends from the securing section 52. In the illustrative embodiment shown, the spring section 54 is a spring with a free end 56. The free end 56 is configured to engage a terminal 44, as will be more fully described. The spring section 54 can be configured to supply the desired or required spring force to maintain the terminals 44 in position.

Figure 7:
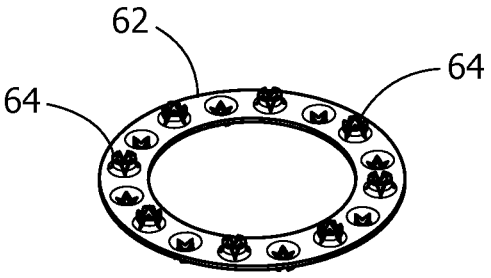
FIG. 7 is a perspective view of an illustrative washer of the terminal post assembly of FIG. 3.
Figure 8:
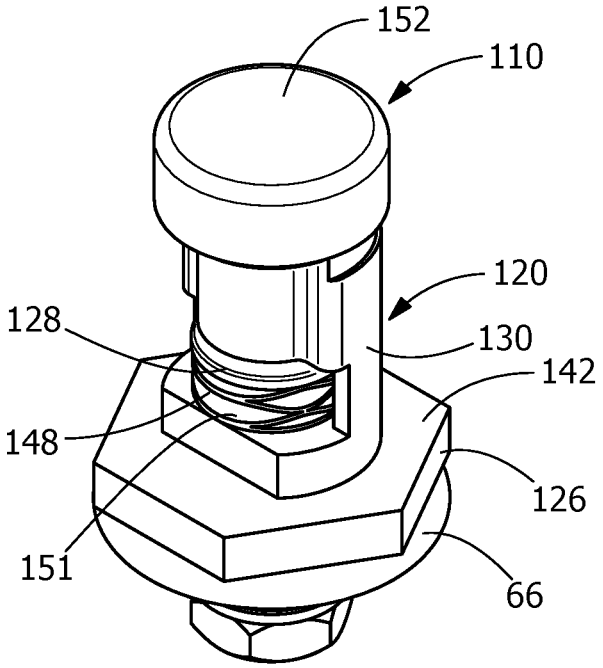
FIG. 8 is a perspective view of an alternate illustrative terminal post assembly of the present invention.
Figure 9:
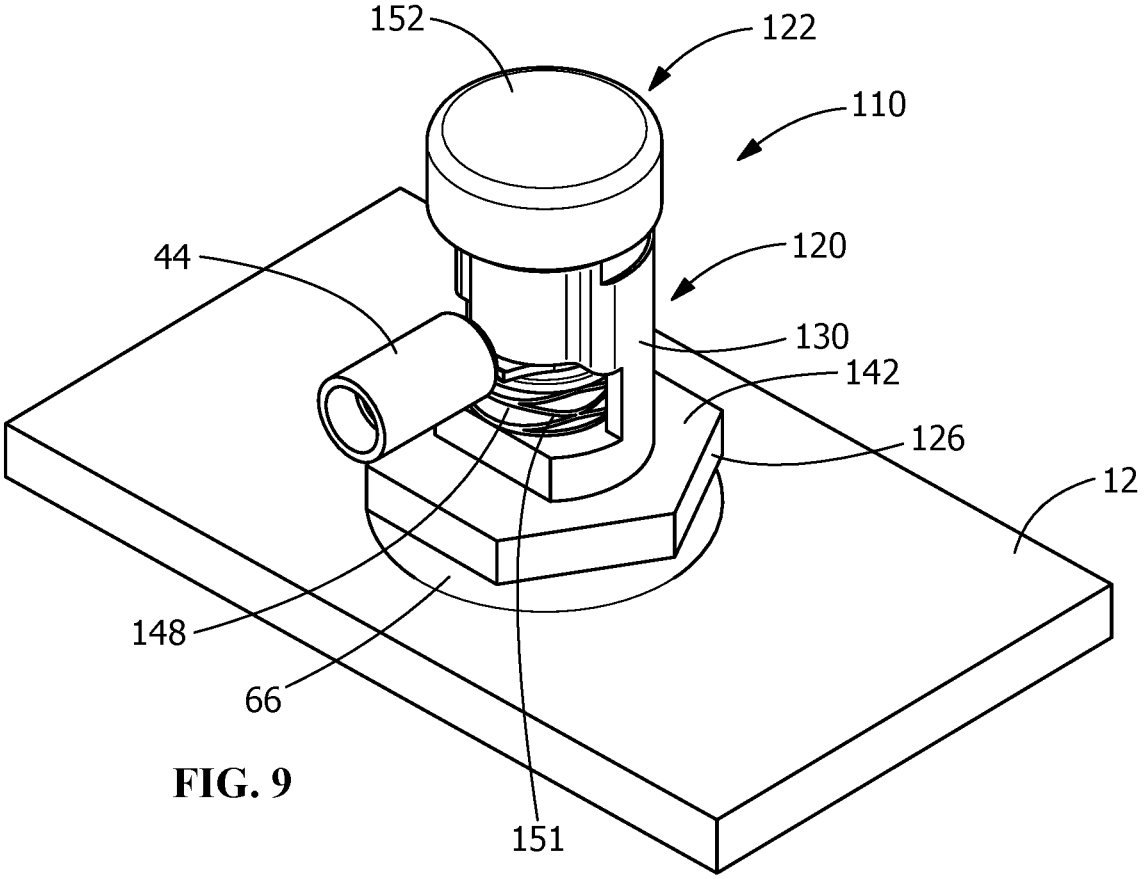
FIG. 9 is a perspective view of the terminal post assembly of FIG. 8, mounted on an illustrative substrate.

During assembly of the terminal post 20 to the substrate 12, a washer 62 is positioned on a surface of the substrate 12 proximate the mounting opening 34. The washer 62 may be, but is not limited to, a monel washer which has sharp projections 64 which extend from one or more surfaces of the washer 62, as shown in FIG. 7. The projections 64 engage the surface of the substrate 12 and the substrate engaging surface 38 of the first portion 36 of the base section 26 as the terminal post 20 is tightened on the substrate 12. The projections 64 penetrate any contaminants, such as oxides, which may be present on either surface, thereby facilitating a positive electrical connector between the base 26 of the terminal post 20 and the substrate 12.

One or more gaskets 66 may also be provided between the substrate engaging surface 38 of the first portion 36 of the base section 26 and the substrate 12 to provide a watertight connection therebetween. The gaskets 66 may be made of rubber or any other material having the characteristics required to provide the seal.

The substrate mounting section 24 of the terminal post 20 is inserted into the mounting opening 34. With the terminal post 20 properly positioned, a gasket 68, washer 70 and securing nut 72 are positioned over the end of the substrate mounting section 24 of the terminal post 20. The securing nut 72 interacts with the threads 32 and the securing nut 72 is tightened to place the terminal post 20 in secure engagement with the substrate 12. In this position the gaskets 66 and 68 provided a watertight connection.

Figure 4:
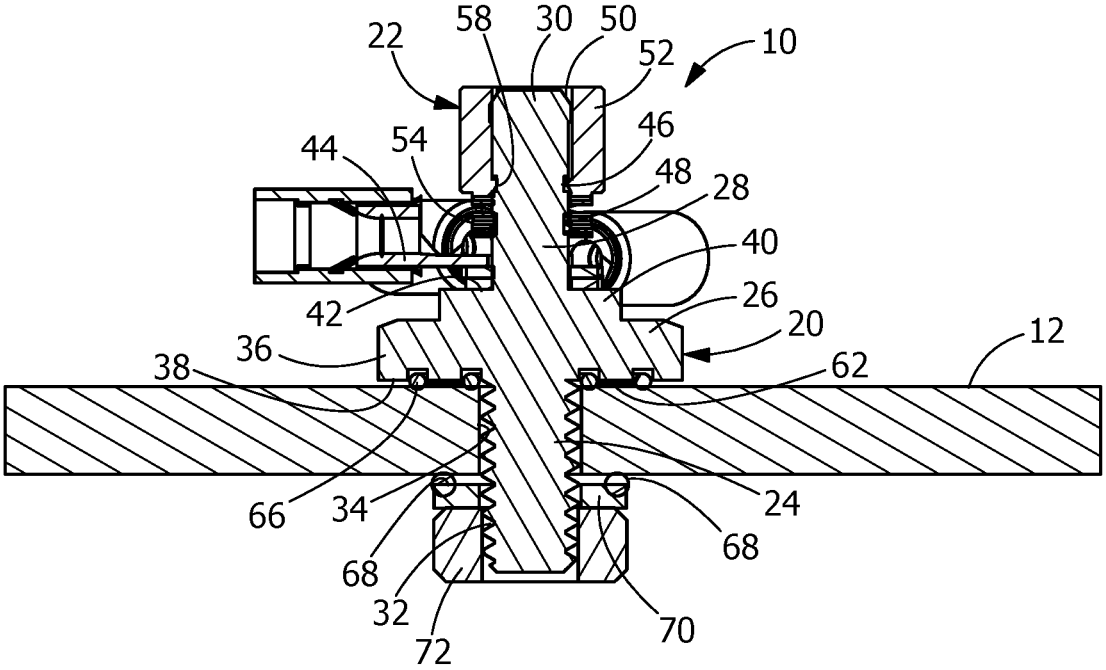
FIG. 4 a cross-sectional view, similar to that shown in FIG. 3, showing the terminal post assembly in a terminal receiving position, with the cap shown in an open or first position.
Figure 5:
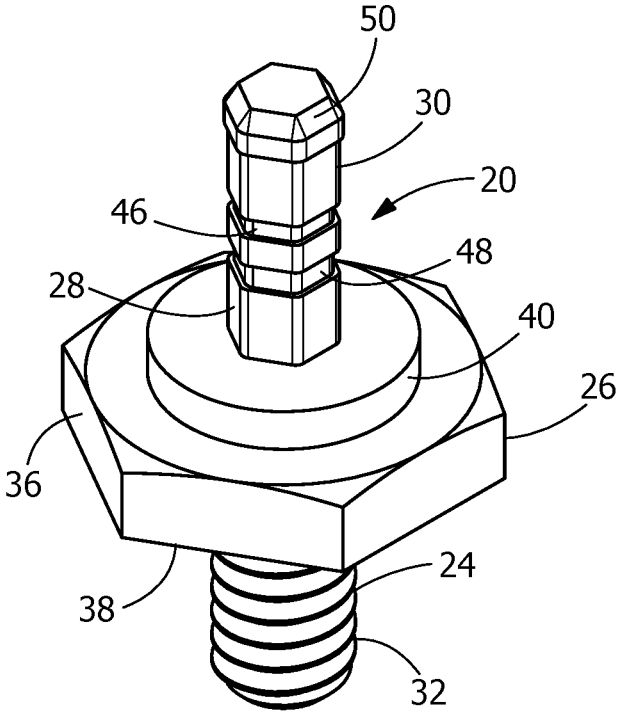
FIG. 5 is a perspective view of an illustrative terminal post of the terminal post assembly of FIG. 1.
Figure 6:
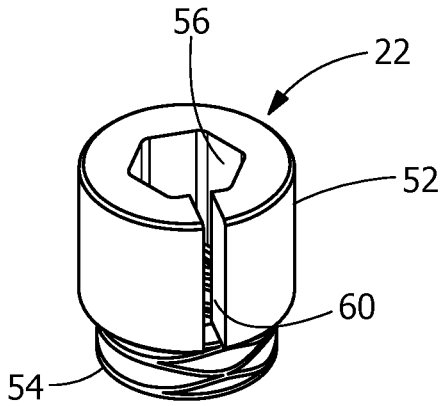
FIG. 6 is a perspective view of the illustrative cap of the terminal post assembly of FIG. 1.

With the terminal post 20 properly mounted, the spring cap 22 is provided in a first or open position, as shown in FIG. 4. In this position, the one or more securing projections 58 are positioned in the first recess 46 and are retained therein until a force is applied to the spring cap 22 to move the spring cap toward the base section 26. In this position, the free end 56 of the spring section 54 is spaced from the terminal support surface 42 of the second portion 40 of the base section 26, to allow terminals 44 to be positioned in the terminal receiving section 28.

Terminals 44 are moved into the terminal receiving section 28. As this occurs, hexagonal recesses 74 of the terminals 44 engage the hexagonal terminal receiving section 28 of the terminal post 20. As the hexagonal recesses 74 and the hexagonal terminal receiving section 28 both have hexagonal configurations, the rotation of the terminals 44 is prevented after the hexagonal recesses 74 of the terminals 44 are properly mated to the hexagonal terminal receiving section 28.

Figure 3:
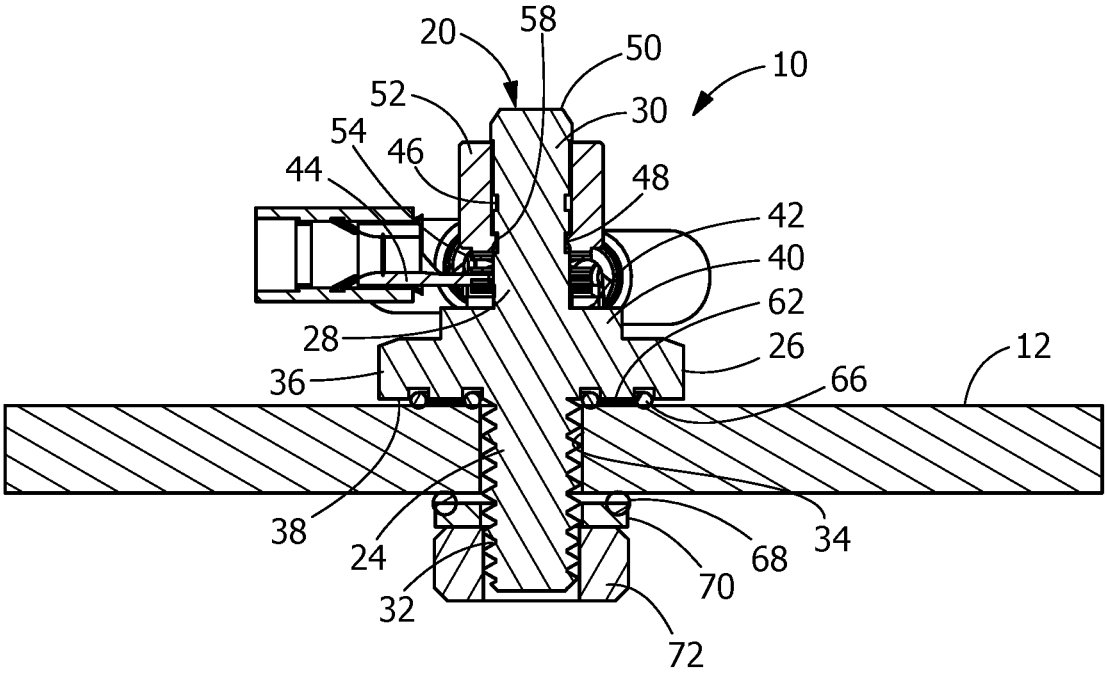
FIG. 3 is a cross-sectional view taken along line 3-3 of FIG. 2, showing the terminal post assembly in a fully mated position, with a cap shown in a closed or second position.

With the one or more terminals 44 properly positioned on the terminal receiving section 28, a force is applied to the spring cap 22 to move the spring cap 22 from the open position, in which the one or more securing projections 58 are positioned in the first recess 46, to the closed position, as shown in FIG. 3, in which the one or more securing projections 58 are positioned in the second recess 48. In this position, the free end 56 of the spring section 54 engages a respective terminal 44. Also in this position, the spring section 54 is compressed, causing the spring section 54 to exert a force on the terminals 44, thereby retaining the terminals on the terminal receiving section 28 between the spring section 54 of the spring cap 22 and the terminal support surface 42 of the second portion 40 of the base section 26 of the terminal post 20. The force applied by the spring section 54 provide a secure mechanical and electrical engagement between the terminals 44 and the terminal post 20. As the terminal post 20 is provided in a secure mechanical and electrical engagement with the substrate 12, the terminal 44 are also provided in a secure mechanical and electrical engagement with the substrate 12.

If the terminals 44 are to be removed, the spring cap 22 is moved from the second position to the first position. This removed the spring force on the terminals 44, allowing the terminals 44 to be removed from the terminal post 20.

A second illustrative embodiment is shown in FIGS. 8 through 13. A terminal post assembly 110 is configured to mounted on a substrate 12, such as, but not limited to, a panel or other component.

The terminal post assembly 110 includes a terminal post 120 and a cap 122. The terminal post 120 has a substrate mounting section 124, a base section 126, a movable terminal receiving section 128 and a housing 130.

In the illustrative embodiment shown, the substrate mounting section 124 extends from the base 126. The substrate mounting section 124 has threads 132. The diameter of the substrate mounting section 124 is smaller than the diameter of a mounting opening 34 which extends through the substrate 12.

The base section 126 has a diameter which is larger than the mounting opening 34. The base section 126 has a substrate engaging surface 138 which is configured to make an electrical engagement with a surface of the substrate 12. The base section 126 has a housing support surface 142 which is configured to support and mount the housing 130.

The movable terminal receiving section 128 is positioned in the housing 130. In the illustrative embodiment shown, the terminal receiving section 128 is configured to receive between one and three terminals 44, however, in other embodiments, the terminal receiving section 128 may be configured to receiving other number of terminals 44. The terminal receiving section 128 has one or more shoulders or projection 126 which have a terminal receiving surface 131 on one surface and a spring engaging surface 133 on the opposed surface.

The housing 130 extends from the base section 126 in a direction away from the mounting section 124. The housing 130 has a moveable terminal receiving opening 146, a spring receiving opening 147, a terminal receiving opening 148 and a cap receiving opening 149. The movable terminal receiving section 128 is positioned in the moveable terminal receiving opening 146 and is movable between a first or open position, shown in FIG. 11 and a second or closed position, shown in FIG. 10. The spring receiving opening 147 is positioned adjacent to the moveable terminal receiving opening 146. The spring receiving opening 147 is configured to receive a resilient member or spring 151 therein. The terminal receiving opening 148 extends through a wall of the housing 130 to the moveable terminal receiving opening 146. The cap receiving opening 149 extends from the spring receiving opening 147 to a free end of the housing 130. The housing 130 may be a one piece housing or may have two or more pieces which are attached together using known methods of attachments, such as, but not limited to, mounting hardware or adhesive.

The cap 122 has an operator engagement portion 152 and a movable terminal receiving section engagement section 154. The movable terminal receiving section engagement section 154 extends through the cap receiving opening 149 to the spring receiving opening 147 to the an opening 56.

During assembly of the terminal post 120 to the substrate 12, a washer 62 is positioned on a surface of the substrate 12 proximate the mounting opening 34. The washer 62 may be, but is not limited to, a monel washer which has sharp projections 64 which extend from one or more surfaces of the washer 62. The projections 64 engage the surface of the substrate 12 and the substrate engaging surface 138 of the base section 126 as the terminal post 120 is tightened on the substrate 12. The projections 64 penetrate any contaminants, such as oxides, which may be present on either surface, thereby facilitating a positive electrical connector between the base section 126 of the terminal post 120 and the substrate 12.

One or more gaskets 66 may also be provided between the substrate engaging surface 138 of the base section 126 and the substrate 12 to provide a watertight connection therebetween. The gaskets 66 may be made of rubber or any other material having the characteristics required to provide the seal.

The substrate mounting section 124 of the terminal post 120 is inserted into the mounting opening 34. With the terminal post 120 properly positioned, a gasket 68, washer 70 and securing nut 72 are positioned over the end of the substrate mounting section 124 of the terminal post 120. The securing nut 72 interacts with the threads 132 and the securing nut 72 is tightened to place the terminal post 120 in secure engagement with the substrate 12. In this position the gaskets 66 and 68 provided a watertight connection.

The cap 122 has an operator engagement portion 152 and a movable terminal receiving section engagement section 154. The movable terminal receiving section engagement section 154 extends through the cap receiving opening 149 to the spring receiving opening 147 to the an opening 56.

Figure 11:
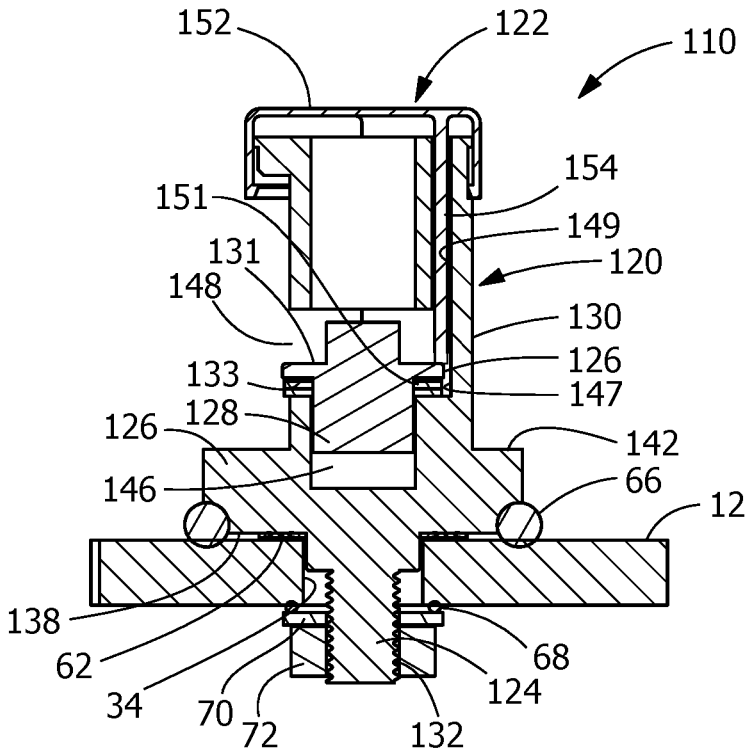
FIG. 11 a cross-sectional view, similar to that shown in FIG. 10, showing the terminal post assembly in a terminal receiving position, with the terminal receiving portion shown in an open position.
Figure 12:
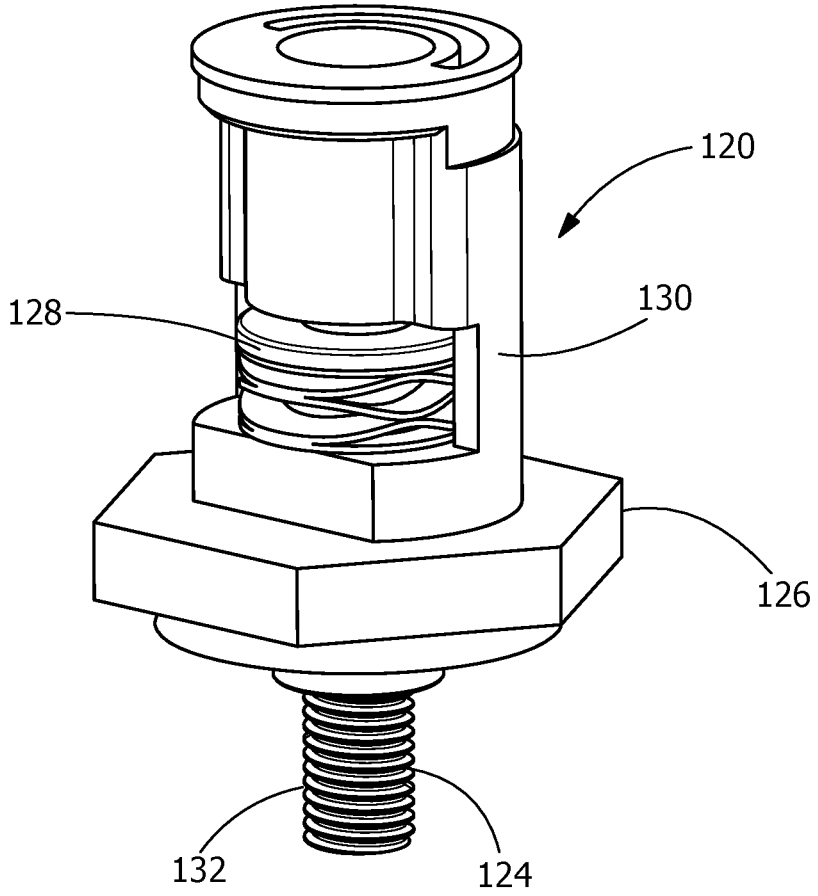
FIG. 12 is a perspective view of an illustrative terminal post of the terminal post assembly of FIG. 8.
Figure 13:
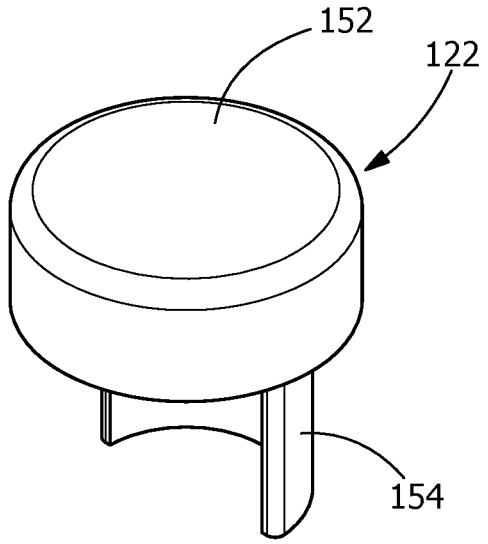
FIG. 13 is a perspective view of an illustrative cap of the terminal post assembly of FIG. 8.
Figure 14:
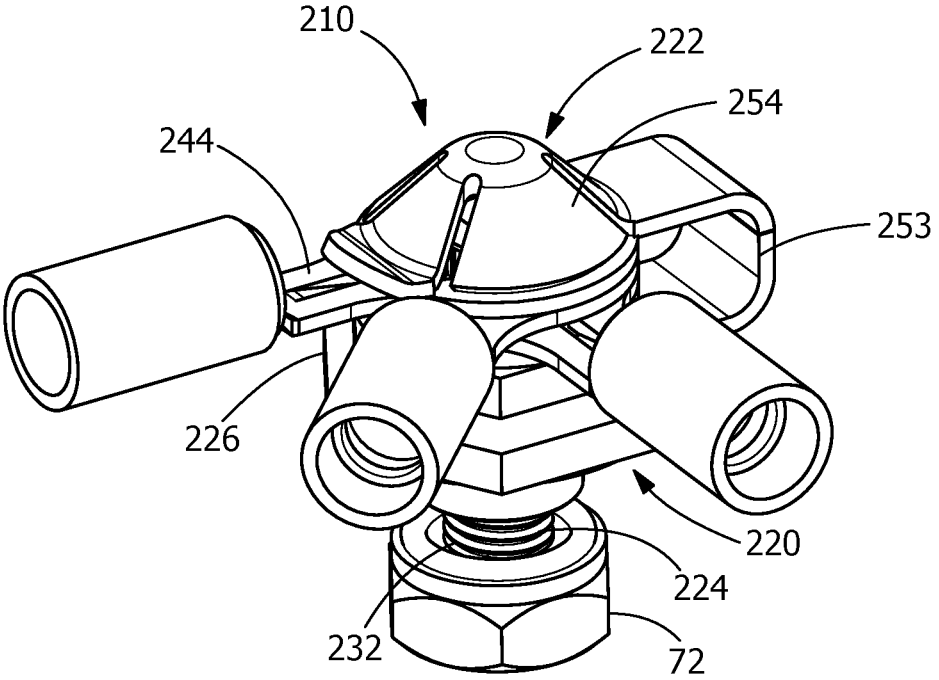
FIG. 14 is a perspective view of another alternate illustrative terminal post assembly of the present invention.
Figure 15:
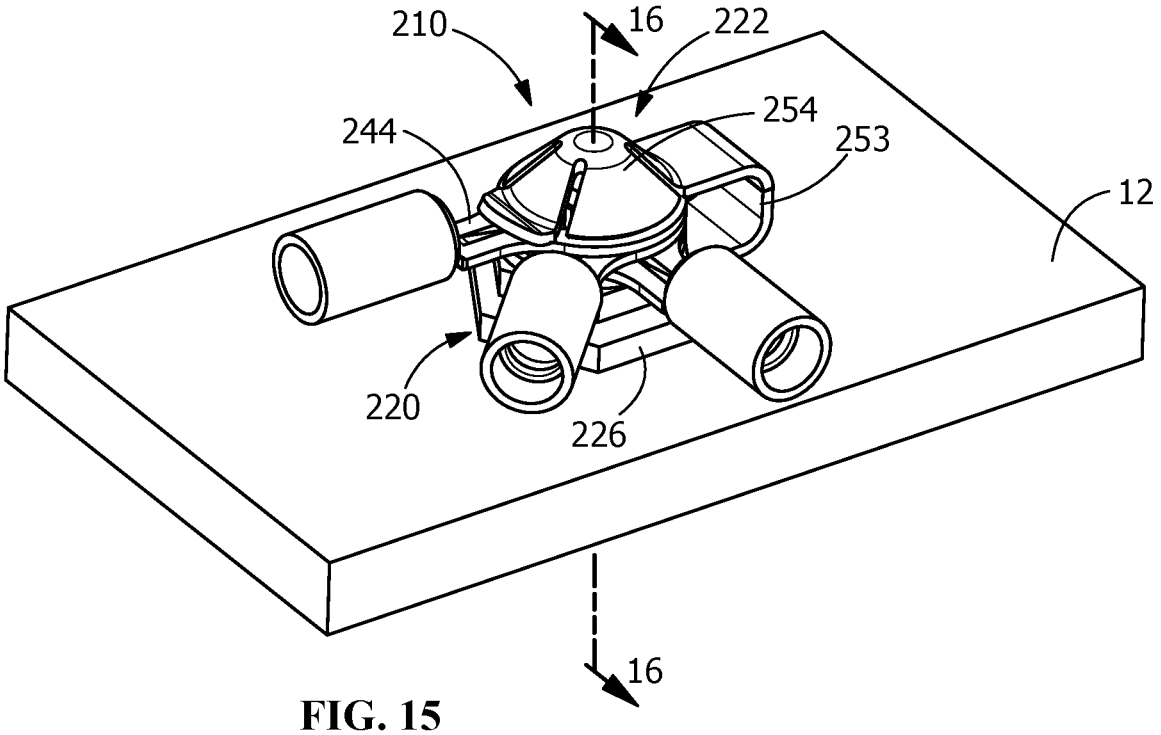
FIG. 15 is a perspective view of the terminal post assembly of FIG. 14, mounted on an illustrative substrate.

With the terminal post 120 properly mounted, the cap 122 is depressed and moved to the open position, as shown in FIG. 11. In this position, the movable terminal receiving section engagement section 154 engages the movable terminal receiving section 128 is depressed, causing the movable terminal receiving section 128 to move to the open position. In the open position, a free end of the movable terminal receiving section 128 to be positioned below the terminal receiving opening 148, thereby allowing the terminals 144 to extend through the terminal receiving opening 148 and in the moveable terminal receiving opening 146 in line with the movable terminal receiving section 128. In this position, the dimension of the terminal receiving opening 148 limit the movement or rotation of the terminals 144. Also in this position, the resilient member or spring 151 is moved to a stressed position.

Figure 10:
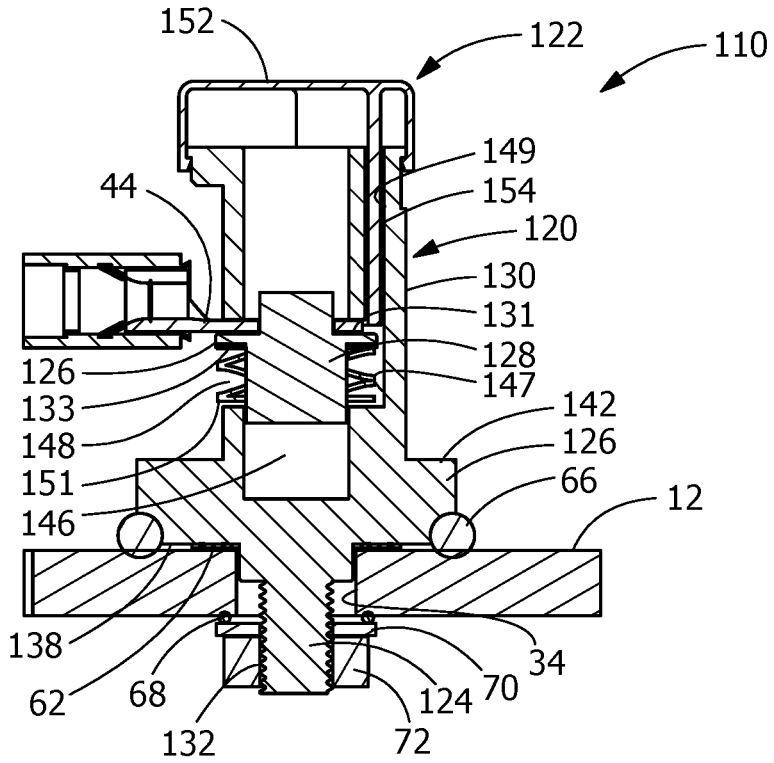
FIG. 10 is a cross-sectional view taken along line 10-10 of FIG. 9, showing the terminal post assembly in a fully mated position, with a terminal receiving portion shown in a closed position.

With the one or more terminals 144 properly positioned in the terminal receiving opening 148, the an operator engagement portion 152 of the cap 122 is released, allowing the movable terminal receiving section engagement section 154 of the cap 122 to move freely. As this occurs, the resilient member or spring 151 is allowed to move back toward the unstressed position, causing the terminal receiving section 128 to be moved to the closed position, as shown in FIG. 10, in which the free end of the movable terminal receiving section 128 is positioned above the terminal receiving opening 148. In this position, the terminal receiving surface 131 of the projection 126 of the terminal receiving section 128 in provided in mechanical and electrical engagement with the terminals 144. Also in this position, the resilient member or spring 151 continues to exert a force on the movable terminal receiving section 128 to retain the movable terminal receiving section 128 in the closed position, thereby preventing the unwanted removal of the terminals 144 from the terminal post 120. As the movable terminal receiving section 128 is biased upward in the closed position, a respective terminal 144 engages a wall of the housing to provide an electrical engagement between the terminals 144 and the housing 130 and the terminal post 120. As the terminal post 120 is provided in a secure mechanical and electrical engagement with the substrate 12, the terminal 144 are also provided in a secure mechanical and electrical engagement with the substrate 12.

If the terminals 44 are to be removed, the cap 122 is again depressed to move the movable terminal receiving section 128 to the open position, allowing the terminals 144 to be removed from the terminal post 120.

A third illustrative embodiment is shown in FIGS. 14 through 18. A terminal post assembly 210 is configured to mounted on a substrate 12, such as, but not limited to, a panel or other component.

The terminal post assembly 210 includes a terminal post 220 and a cap 222. The terminal post 220 has a substrate mounting section 224, a base section 226, a terminal receiving section 228 and a first cap receiving section 229 and a second cap receiving section 230.

In the illustrative embodiment shown, the substrate mounting section 224 extends from the base 226. The substrate mounting section 224 has threads 232. The diameter of the substrate mounting section 224 is smaller than the diameter of a mounting opening 34 which extends through the substrate 12.

The base section 226 has a diameter which is larger than the mounting opening 34. The base section 226 has a substrate engaging surface 238 which is configured to make an electrical engagement with a surface of the substrate 12.

The first cap receiving section 229 extends from the base section 226 in a direction away from the substrate mounting section 224. The diameter of the first cap receiving section 229 is less than the diameter of the base section 226.

The terminal receiving section 228 extends from the first cap receiving section 229. The terminal receiving section 228 has an enlarged portion 231 and a terminal engaging portion 233. The enlarged portion has a terminal receiving surface 235. The terminal engaging portion 233 has a smaller diameter than the diameter of the enlarged portion 231. The terminal engaging portion 233 is configured to receive between one and three terminals 244, however, in other embodiments, the terminal engaging portion 233 may be configured to receiving other number of terminals 244. The terminal engaging portion 233 has an irregular surface or projections 237. The projections 237 cooperate with the terminals 244 when the terminals 244 are positioned on the terminal engaging portion 233 to prevent the rotation of the terminals 244 relative to the terminal engaging portion 233.

The second cap receiving section 230 is provided at a free end of the terminal engaging portion 233. The terminal engaging portion 233 has one or more projections 246 which extend outwardly from the terminal engaging portion 233. In the illustrative embodiment shown, the projection 246 extends about the entire circumference of the second cap receiving section 230. The projection 246 has a securing shoulder 247 and a sloped or lead in surface 248.

Figure 16:
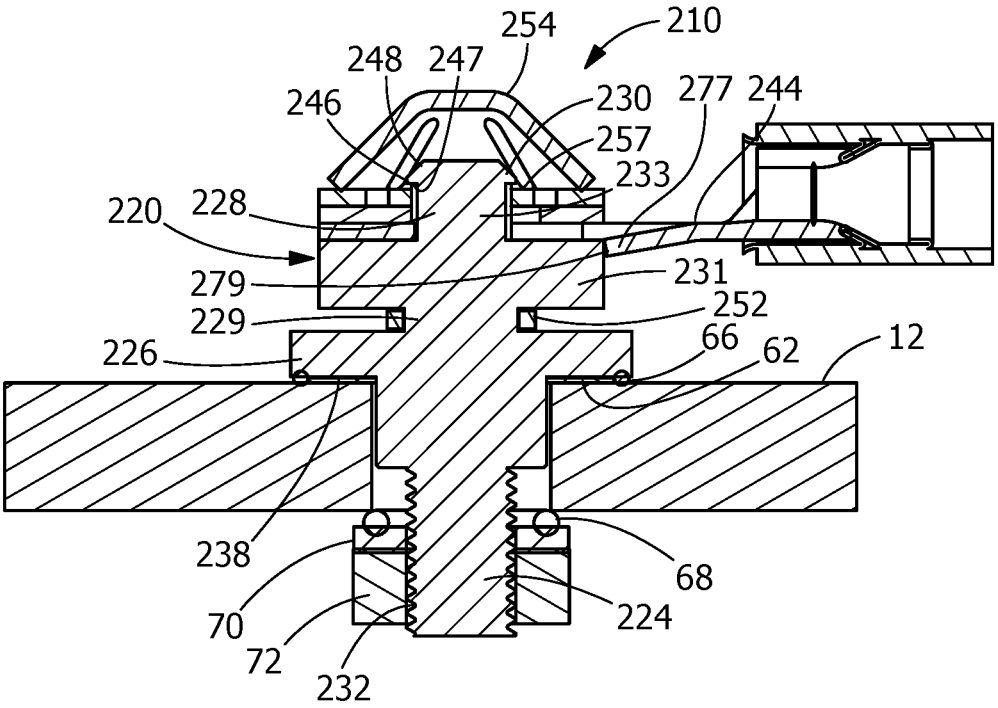
FIG. 16 is a cross-sectional view taken along line 16-16 of FIG. 15, showing the terminal post assembly in a fully mated position, with a cap shown in a closed position.
Figure 17:
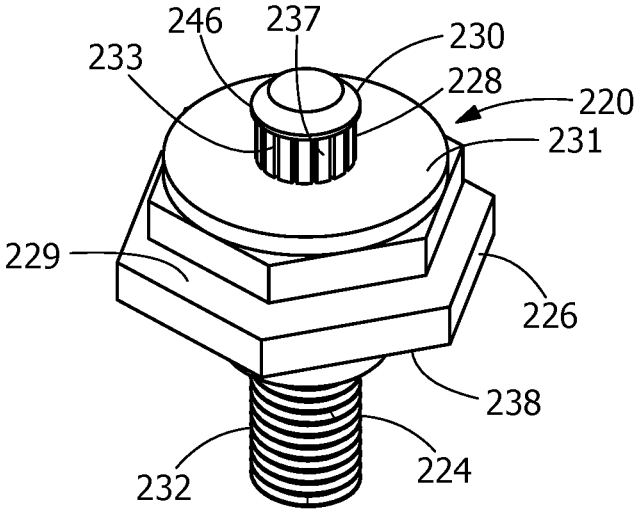
FIG. 17 is a perspective view of an illustrative terminal post of the terminal post assembly of FIG. 14.
Figure 18:
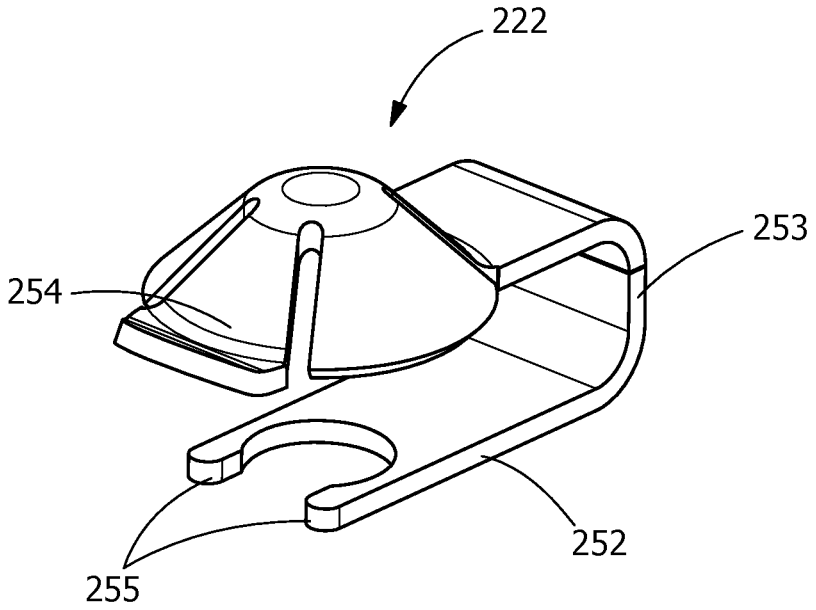
FIG. 18 is a perspective view of the illustrative cap of the terminal post assembly of FIG. 14.

The cap 222 has a cap retaining portion 252 and a terminal retaining portion 254. A flexible member 253 is provided between the cap retaining portion 252 and a terminal retaining portion 254. The cap retaining portion 252 has resilient arms 255 which extend around the first cap receiving section 229 to retain the cap retaining portion 252 and the cap 222 in position on the terminal post 230. The terminal retaining portion 254 has one or more shoulders 257 which cooperate with the one or more projections 246 to retain the terminal retaining portion 254 in the closed position, as shown in FIG. 16.

Figure 19:
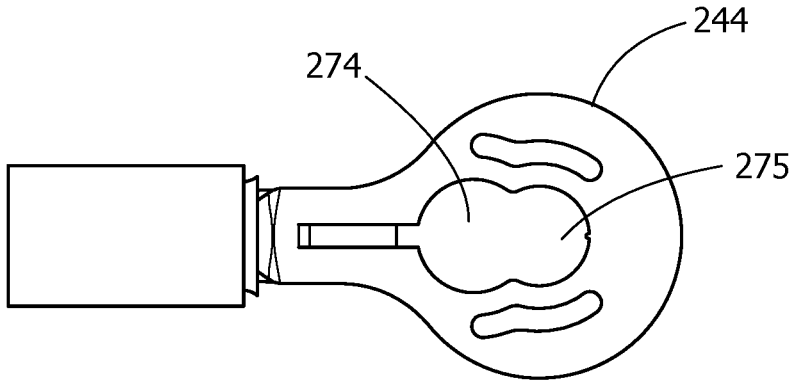
FIG. 19 is a top view of a terminal used with the terminal post assembly of FIG. 14.

The terminals 244, as shown in FIG. 19, have post receiving openings 274 and post securing openings 275. The post receiving openings 274 have a larger diameter than the post securing openings 275 and a larger diameter than the terminal engaging portion 233. The post receiving openings 274 intersect the post securing openings 275. A latching projection 277 is provide on each terminal 244. The latching projections 277 have free ends 279 which extend out of the plane of the terminals 244.

During assembly of the terminal post 220 to the substrate 12, a washer 62 is positioned on a surface of the substrate 12 proximate the mounting opening 34. The washer 62 may be, but is not limited to, a monel washer which has sharp projections 64 which extend from one or more surfaces of the washer 62. The projections 64 engage the surface of the substrate 12 and the substrate engaging surface 238 of the base section 226 as the terminal post 220 is tightened on the substrate 12. The projections 64 penetrate any contaminants, such as oxides, which may be present on either surface, thereby facilitating a positive electrical connector between the base section 226 of the terminal post 220 and the substrate 12.

One or more gaskets 66 may also be provided between the substrate engaging surface 238 of the base section 226 and the substrate 12 to provide a watertight connection therebetween. The gaskets 66 may be made of rubber or any other material having the characteristics required to provide the seal.

The substrate mounting section 224 of the terminal post 220 is inserted into the mounting opening 34. With the terminal post 220 properly positioned, a gasket 68, washer 70 and securing nut 72 are positioned over the end of the substrate mounting section 224 of the terminal post 220. The securing nut 72 interacts with the threads 232 and the securing nut 72 is tightened to place the terminal post 220 in secure engagement with the substrate 12. In this position the gaskets 66 and 68 provided a watertight connection.

With the terminal post 220 properly mounted and the terminal retaining portion 254 of the cap 222 in the open position, the terminals 244 are moved onto terminal engaging portion 233. As this occurs, the post receiving openings 274 are positioned in line with the terminal engaging portion 233. With the terminals 244 moved toward the terminal receiving surface 235, the terminals 244 are moved to the side to allow the post securing openings 275 to be positioned in line with the terminal engaging portion 233, thereby allowing the terminals 244 to be provide in electrical and mechanical engagement with the terminal engaging portion 233 and the terminal post 220. The terminals 244 are retained in this position by the cooperation of the free ends 279 of the latching projections 277 with the enlarged portion 231 or with an adjacent terminal 244.

With the one or more terminals 244 properly positioned on the terminal engaging portion 233, the terminal retaining portion 254 of the cap 222 is moved to the closed position, in which the one or more shoulders 257 which cooperate with the one or more projections 246. In this position, the terminals 244 cannot be removed from the terminal engaging portion 233 and the terminal post 220. As the terminal post 220 is provided in a secure mechanical and electrical engagement with the substrate 12, the terminals 244 are also provided in a secure mechanical and electrical engagement with the substrate 12.

If the terminals 44 are to be removed, the terminal retaining portion 254 of the cap 222 is moved to the open position. The latching projections 277 are depressed and the terminals 244 are moved to position the post receiving openings 274 are positioned in line with the terminal engaging portion 233, allowing the terminals 244 to be removed from the terminal engaging portion 233.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A terminal post assembly for connecting at least one electrical terminal to a substrate, the terminal post assembly comprising:

a terminal post having a substrate mounting portion, a terminal receiving portion and a cap receiving portion, the cap receiving portion having a first recess and a second recess which is spaced from the first recess;

the substrate mounting portion having a base and a securing portion which is dimensioned to extend through a mounting opening of the substrate, a securing member is attached to the substrate mounting portion to retain the substrate mounting portion and the terminal post assembly in electrical connection with the substrate;

the terminal receiving portion being configured to receive the at least one electrical terminal thereon and make an electrical connection to the at least one electrical terminal;

the cap receiving portion having a cap positioned thereon, the cap having projections extending inward from a cap securing portion, the projections cooperate with the first recess to maintain the cap in a first position, in which the at least one electrical terminal can be positioned in the terminal receiving portion, the projections cooperate with the second recess to maintain the cap in the second position, the cap cooperating with the at least one electrical terminal when the cap is in the second position to retain the at least one electrical terminal in position on the terminal receiving portion to maintain the electrical connection between the at least one electrical terminal and the terminal receiving portion of the terminal post of the terminal post assembly.

2. The terminal post assembly as recited in claim 1, wherein a washer is provided between the base of the substrate mounting portion and the substrate, the washer has projections with extend from a top surface and a bottom surface, the projections engage a surface of the base and a surface of the substrate to penetrate contaminants present on the surface of the base or the surface of the substrate.

3. The terminal post assembly as recited in claim 2, wherein the washer has sharp projections which extend from one or more surfaces of the washer.

4. The terminal post assembly as recited in claim 1, wherein one or more gaskets are provided between the base and the substrate.

5. The terminal post assembly as recited in claim 1, wherein the securing member is a nut which engages threads of the securing portion of the substrate mounting portion.

6. The terminal post assembly as recited in claim 1, wherein the cap has a resiliently deformable portion which extends from the securing portion.

7. The terminal post assembly as recited in claim 6, wherein the resiliently deformable portion of the cap is a spring which extends from the securing portion of the cap, the spring cooperates with the at least one electrical terminal positioned in the terminal receiving portion to retain the at least one electrical terminal in the terminal receiving portion.

8. The terminal post assembly as recited in claim 1, wherein the terminal receiving portion has a hexagonal configuration to prevent the rotation of the at least one electrical terminal positioned in the terminal receiving portion of the terminal post assembly.

* * * * *